US007481664B1

(12) United States Patent
Knoll et al.

(10) Patent No.: US 7,481,664 B1
(45) Date of Patent: Jan. 27, 2009

(54) ELECTRICAL CONNECTOR ASSEMBLY

(75) Inventors: John K. Knoll, Lebanon, PA (US); Dominic A. Farole, Hummelstown, PA (US); Timothy M. Beck, York Haven, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/137,737

(22) Filed: Jun. 12, 2008

(51) Int. Cl.
*H01R 13/627* (2006.01)

(52) U.S. Cl. ..... 439/359

(58) Field of Classification Search ..... 439/350, 439/352, 358
See application file for complete search history.

(56) References Cited

U.S. PATENT DOCUMENTS

| | | | | |
|---|---|---|---|---|
| 4,687,263 | A | 8/1987 | Cosmos et al. | |
| 5,203,723 | A | 4/1993 | Ritter | |
| 5,509,823 | A | 4/1996 | Harting et al. | |
| 5,934,939 | A | 8/1999 | Thenaisie et al. | |
| 6,183,275 | B1 | 2/2001 | Okura et al. | |
| 6,257,914 | B1 * | 7/2001 | Comerci et al. | 439/357 |
| 6,276,945 | B1 | 8/2001 | Hayward et al. | |
| 6,431,902 | B1 * | 8/2002 | Yeh | 439/358 |
| 6,547,605 | B2 | 4/2003 | Daugherty et al. | |
| 6,638,108 | B2 | 10/2003 | Tachi | |
| 6,786,777 | B2 | 9/2004 | Sakatani | |
| 6,916,188 | B2 | 7/2005 | Lang et al. | |
| 7,059,916 | B2 | 6/2006 | Nishide | |
| 7,077,684 | B2 | 7/2006 | Sasame et al. | |
| 7,160,137 | B1 * | 1/2007 | Yeh | 439/358 |
| 7,201,609 | B2 | 4/2007 | Ishikawa | |

* cited by examiner

*Primary Examiner*—Briggitte R Hammond

(57) ABSTRACT

An electrical connector assembly is disclosed. A rectangular plug and rectangular receptacle engage to provide a sealed and durable connector. The electrical connector assembly provides electric, fluid, data and other suitable information suitable for surgical, medical or other device applications. A latch is used to secure the plug with the receptacle and prevent the plug from being easily removed from the receptacle. The connector is substantially sealed to prevent fluid, dust particles and/or other matter from entering the components and damaging the connector assembly.

19 Claims, 7 Drawing Sheets

ELECTRICAL CONNECTOR ASSEMBLY

FIELD OF THE INVENTION

The present invention is directed to an electrical connector assembly. More specifically, the present invention is directed to a reusable, rectangular electrical connector assembly.

BACKGROUND OF THE INVENTION

Surgical and medical devices utilize connector assemblies for electronic and power communication. It is particularly important in surgical and medical devices to establish and maintain reliable electrical connections in connector assemblies, even after many uses. Connector assemblies that include rotary interfaces or other uniquely shaped or configured mechanical or electrical interfaces may experience intermittent or inadequate electrical connections if the contacts used within the connector experience feedback or interference. Connector assemblies are repeatedly engaged and disengaged in normal use of surgical or medical devices. The repeated cycles cause friction between the contact pins and wear to the connector assembly components. In addition to withstanding the wear sustained by a connector assembly during normal use, a connector assembly must also be resilient to fluids, dust particles and/or other matter that may contact or penetrate the connector assembly during normal use, causing damage to the connector assembly. Further, circular or other similarly configured connector assemblies experience interference and/or cross talk because of limited clearance between the contacts in such configurations. It is desirable to have a connector assembly that will withstand repeated usage over an extended period without fracturing or deteriorating, thereby eliminating the need to replace an entire piece of expensive equipment when the connector assembly is damaged or worn out. Typically, a connector assembly must be replaced before five thousand usage cycles due to deterioration and/or external factors such as fluids, dust particles and/or other matter entering the connector.

Thus, there is a need for a connector assembly that provides consistent and reliable performance after extended use, and specifically a connector assembly capable of withstanding several thousand usages. What is also needed is a connector assembly that seals fluids, dust particles and/or other matter from entering the connector assembly and causing damaging.

SUMMARY OF THE INVENTION

The present invention is directed to an electrical connector assembly having a rectangular plug and a rectangular receptacle. The rectangular plug includes a plug housing with an upper plug housing. The plug also has a lower plug housing configured to mate with the upper plug housing. The plug further includes a plug shield with an upper plug shield and a lower plug shield configured to mate with the upper plug shield, The mated upper plug shield and lower plug shield are disposed in the mated upper plug housing and lower plug housing. The plug also has a plug terminal insert with at least one contact and the plug terminal insert is disposed in the plug shield. The plug also has a latch with a button, an arm section and a pawl section. The latch rotates about a pivot point. The rectangular receptacle includes a receptacle housing, a receptacle shield that mates with the receptacle housing and a receptacle terminal insert having an aperture for receiving the pawl. The receptacle also has and a least two contacts corresponding with the at least one contact. The receptacle terminal insert is disposed in the receptacle shield. The pawl engages with the pawl aperture to secure the rectangular plug to the rectangular receptacle when the rectangular plug and the rectangular receptacle are mated.

The present invention is further directed to an electrical connector assembly with a rectangular plug having at least one contact and a latch member and a rectangular receptacle matable with the rectangular plug. The rectangular receptacle has at least one contact and a receiver for the latch member. The latch member engages with the receiver to secure the plug to the receptacle and the plug is removable from the receptacle when the latch is disengaged. The latch is sealed with a cover to substantially seal the plug.

An advantage of the present invention is a rectangular configured electrical connector assembly, which provides greater clearance between contacts, thereby minimizing electrical interference or cross-talk between the contacts.

Yet another advantage of the present invention is the communication capability of the contacts, which may provide communication for data, power, fluids, or any combination thereof.

Still another advantage of the present invention is a latching mechanism, which may provide a tactile and/or audible notification when the latch has secured the plug to the receptacle.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

Wherever possible, the same reference numbers will be used throughout the drawings to refer to the same or like parts.

DETAILED DESCRIPTION OF THE INVENTION

Figure 1:
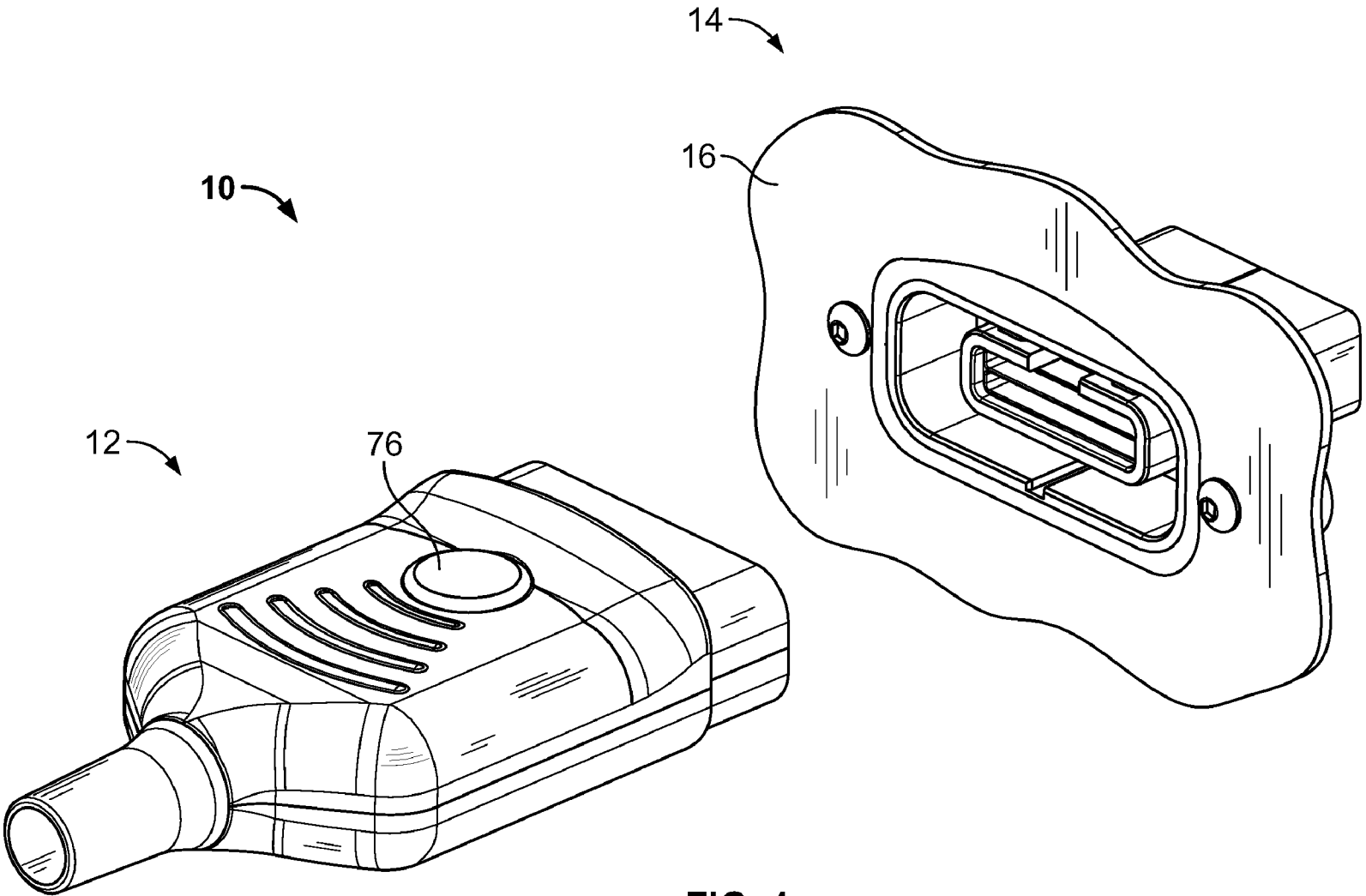
FIG. 1 shows a perspective view of the plug and receptacle for a connector assembly in an unmated position.

Exemplary embodiments of the present invention are now described with reference to the figures. Reference numerals are used throughout the detailed description to refer to the various elements and structures. In other instances, well-known structures and devices are shown in block diagram form for purposes of simplifying the description. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

Figure 2:
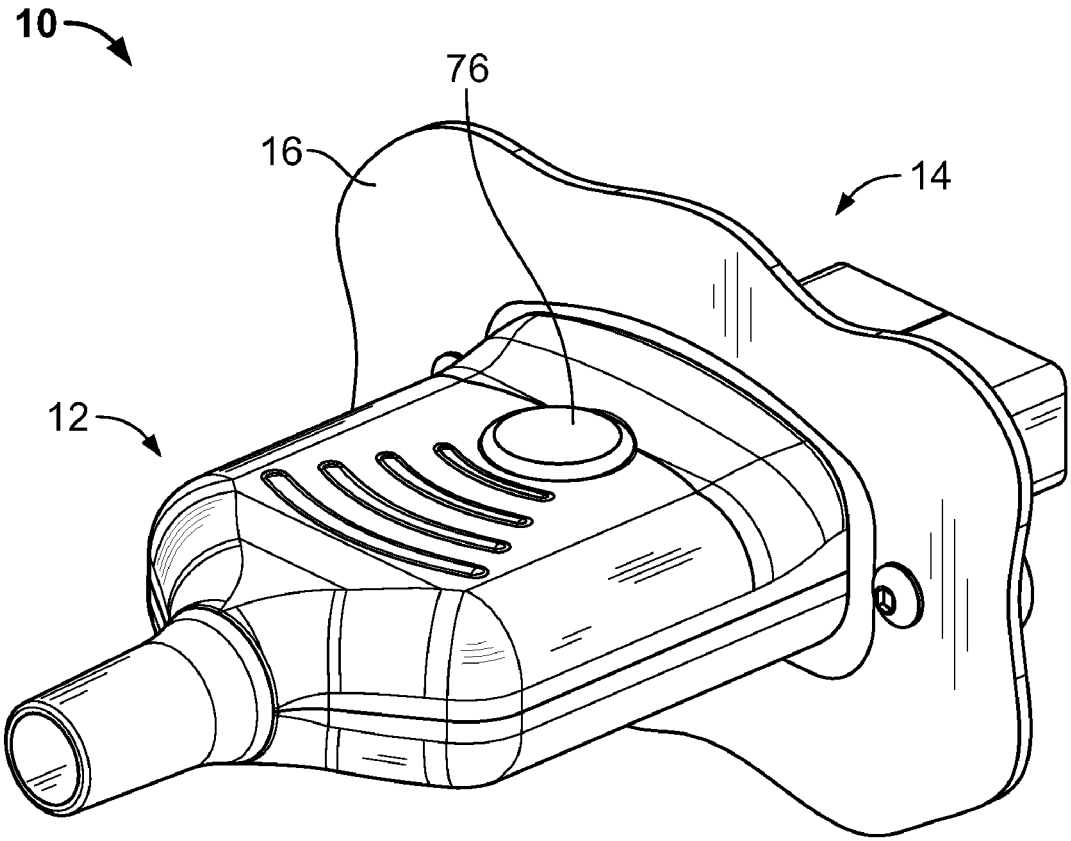
FIG. 2 shows a perspective view of the plug and receptacle for a connector assembly in a mated position.
Figure 3:
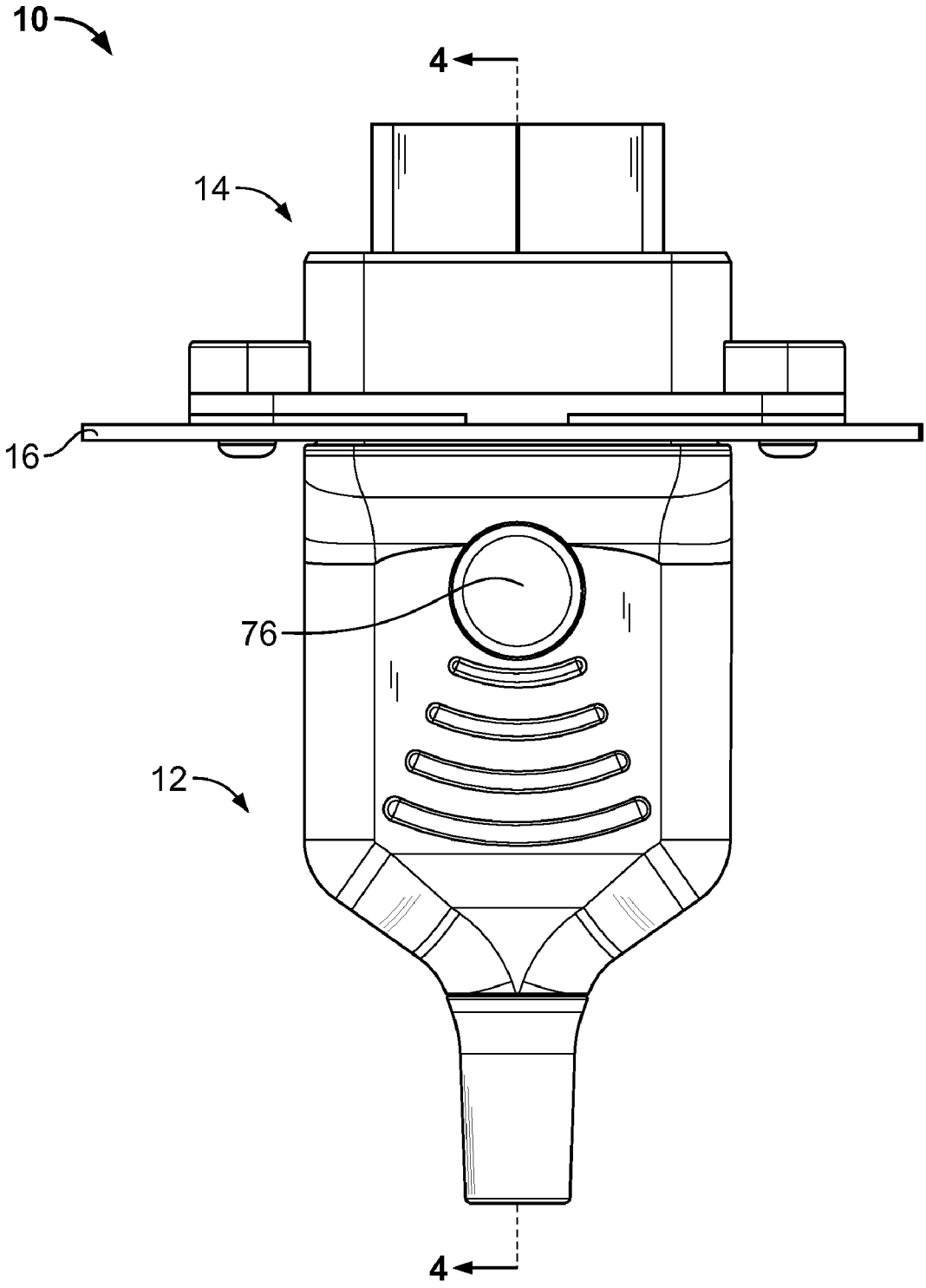
FIG. 3 shows a plan view of a connector assembly in a mated position.

FIGS. 1-3 show an embodiment of an electrical connector assembly 10. Electrical connector assembly 10 may be used with surgical, medical or any other suitable applications. Electrical connector assembly 10 has a male portion or plug portion 12, hereinafter referred to as 'plug', and a female portion or receptacle portion 14, hereinafter referred to as 'receptacle'. Plug 12 includes at least one contact 36 (see FIG. 4) and receptacle 14 includes at least one contact 34 (see FIG. 4). Plug contacts 36 are in communication with receptacle contacts 34 when plug 12 and receptacle 14 are in the mated position (see FIG. 2). Plug contacts 36 and receptacle contacts 34 may be in electronic, data, fluidic, or any combination thereof, communication with each other when plug 12 and receptacle 14 are in the mated position. A fluidic connector (not shown) would provide a contained liquid flow path rather than an electrical connection and may be used alone or in combination with electrical contacts.

Receptacle 14 is typically disposed in a control box or other suitable enclosure, represented by a fragmented section of panel 16. While reference is made to a control box or panel 16 in the current application, any suitable type of enclosure may be used for electrical connector assembly 10. Electrical connector assembly 10 has a rectangular configuration, however electrical connector assembly 10 may have any suitable non-circular configuration such as elliptical. A rectangular shape may provide more clearance between plug contacts 36 and receptacle contacts 34. Further, a rectangular configuration may substantially reduce or substantially eliminate cross talk or interference between plug contacts 36 and receptacle contacts 34. In addition, the rectangular configuration may also provide easier access to plug contacts 36 and receptacle contacts 34 during assembly of electrical connector assembly 10.

Figure 4:
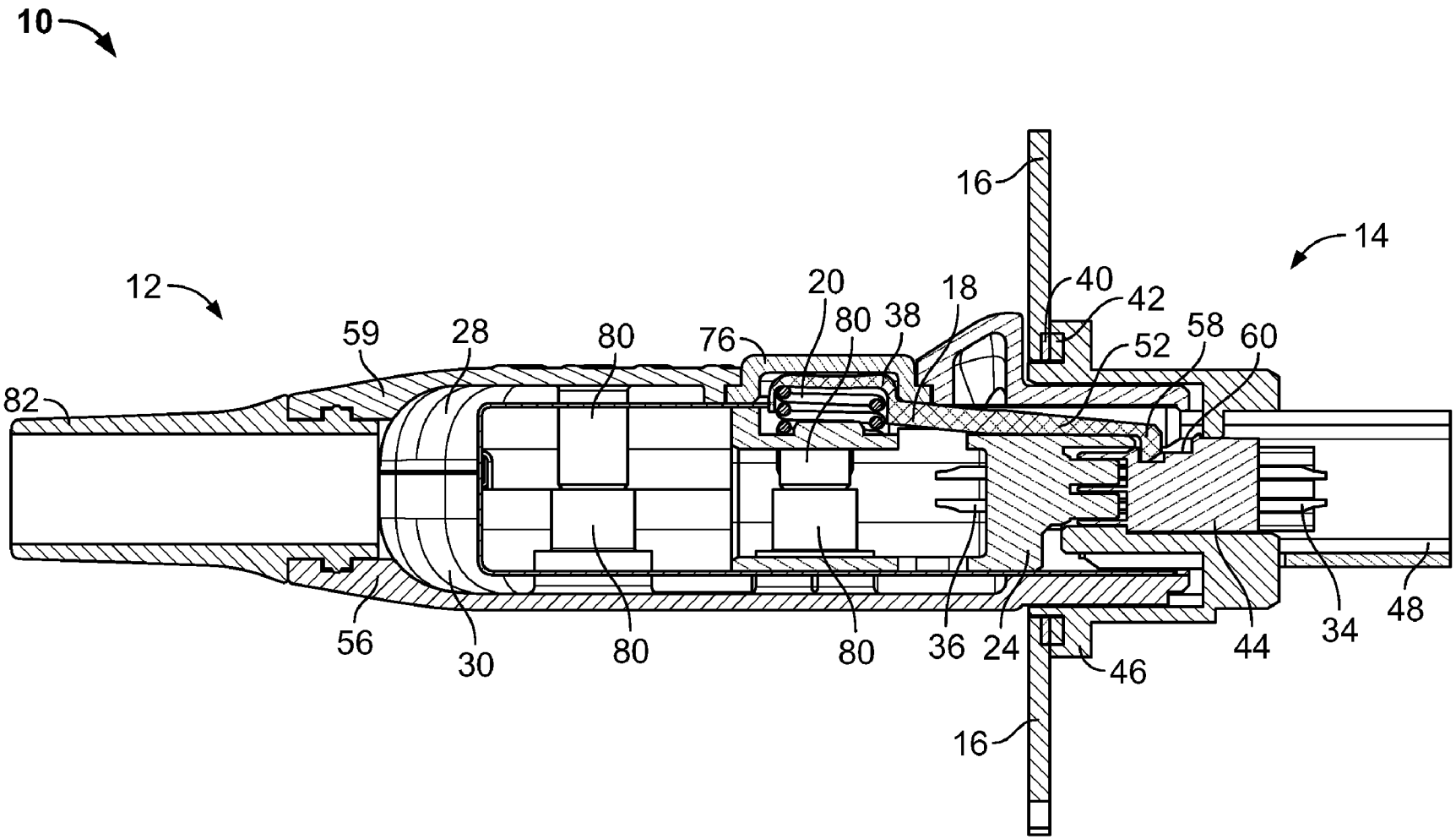
FIG. 4 shows a cross-sectional view taken about lines 4-4 of FIG. 3, when the latch is in the engaged position.
Figure 5:
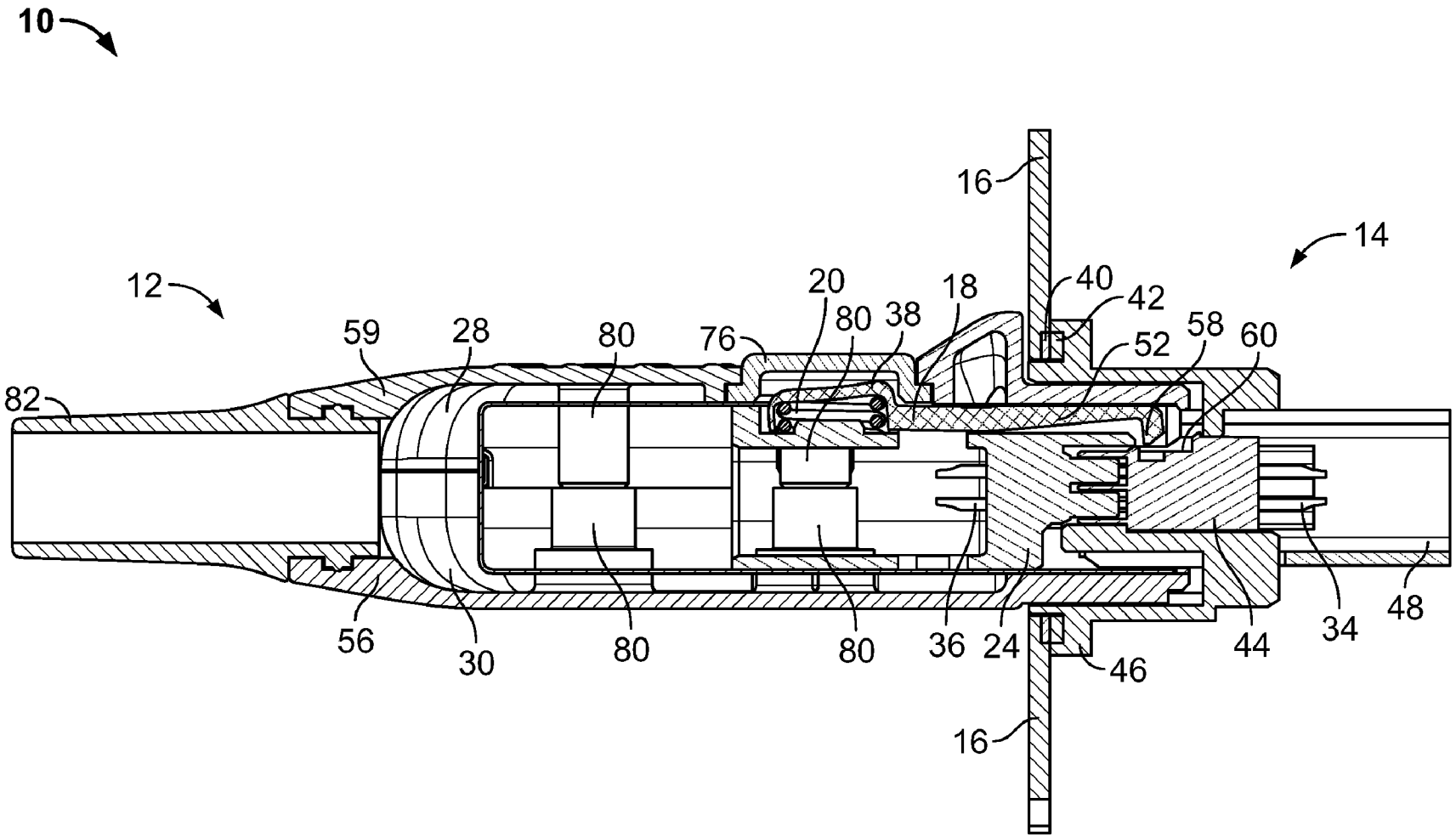
FIG. 5 shows a cross-sectional view taken about lines 4-4 of FIG. 3 when the latch is in the disengaged position.
Figure 6:
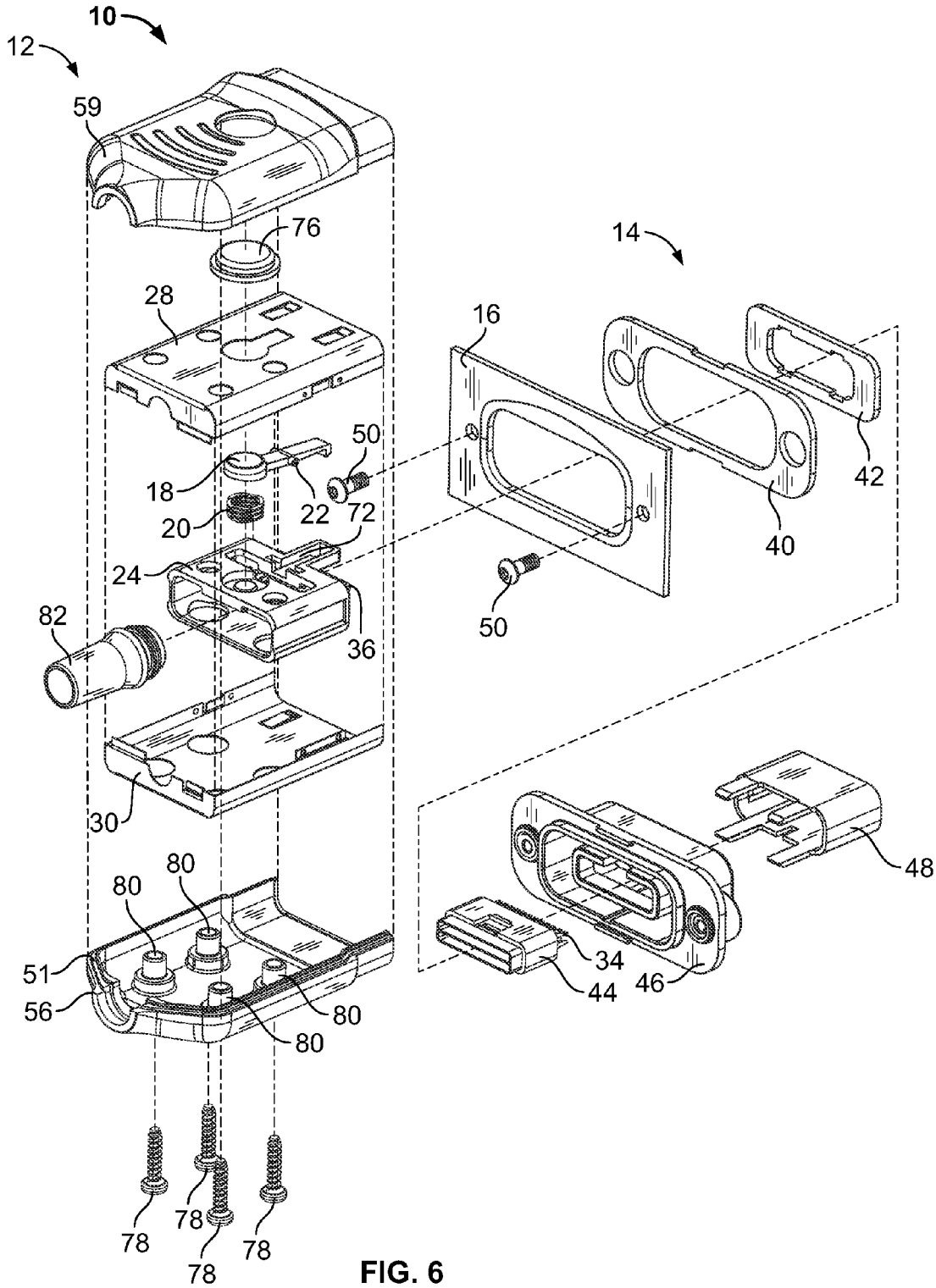
FIG. 6 shows an exploded view of the male and female components of the electrical connector assembly in FIGS. 1 through 5.

Referring next to FIGS. 4-6, plug 12 is mated with receptacle 14 when plug 12 is inserted into receptacle 14 protruding through panel 16. Latch 18 is a fastening mechanism that secures plug 12 to receptacle 14 when plug 12 is mated with receptacle 14. Latch 18 may be a rigid material such as plastic, to provide a levering motion between an engaged and disengaged position. Latch 18 includes a button 38, an arm section 52 and a pawl section 58. A spring 20 is disposed beneath latch 18 to provide a spring force against latch 18 to maintain latch 18 in an engaged position to secure plug 12 to receptacle 14. Spring 20 may be disposed beneath button 38, however spring 20 may be disposed along any suitable section of latch 18. Pawl section 58 engages with a pawl aperture 60 in receptacle 14 to secure plug 12 to receptacle 14 when plug 12 and receptacle 14 are mated. When button 38 is pushed downward into spring 20, arm section 52 pivots about a pivot point 22. Pawl section 58 is displaced upward, releasing pawl section 58 from pawl aperture 60. While spring 20 is described herein, any suitable resistant or spring-like device may be used to provide a force against latch 18 to maintain latch 18 in an engaged position to secure plug 12 to receptacle 14.

Plug 12 is not removable from receptacle 14 once plug 12 is mated with receptacle 14 unless button 38 is pressed into spring 20 to release pawl section 58 from pawl aperture 60. In addition, when latch 18 is moved from the disengaged position to the engaged position, or when latch 18 is moved from the engaged position to the disengaged position, latch 18 may produce an audible sound and/or a tactile feel to alert the user that the engaged or disengaged position has been attained. Further, any other suitable warning or alert mechanism, sound, or warning may be used to alert the user that the engaged or disengaged position has been attained. While latch 18 and spring 20 have been described as the securing or fastening mechanism for securing plug 12 to receptacle 14, any suitable fastening mechanism or fastener may be used to secure plug 12 to receptacle 14. Plug 12 is a rectangular configuration, however plug 12 may be any suitable non-circular configuration such as elliptical. A rectangular shape may provide more clearance between contacts (not shown). Further, a rectangular configuration may substantially reduce or substantially eliminate cross talk or interference between contacts (not shown). In addition, the rectangular configuration may also provide easier access to contacts (not shown) during assembly of electrical connector assembly 10.

Plug 12 may include components such as an upper plug housing 59, a lower plug housing 56, a cable strain relief 82, an upper plug shield 28, a lower plug shield 30, a plug terminal insert 24, a spring 20, and a latch 18. Plug terminal insert 24 includes at least one contact 36 and receptacle 14 includes at least one contact 34. Plug contacts 36 are in communication with receptacle contacts 34 when plug 12 and receptacle 14 are in the mated position (See, e.g. FIG. 2). Plug contacts 36 and receptacle contacts 34 may be in electronic, data, fluidic, or any combination thereof, communication with each other when plug 12 and receptacle 14 are in the mated position. A fluidic connector (not shown) would provide a contained liquid flow path rather than an electrical connection and may be used alone or in combination with electrical contacts.

Plug contacts 36 or receptacle contacts 34 are spring-loaded contacts, sometimes referred to as pogo pin connectors. Plug contacts 36 and receptacle contacts 34 are arrayed in a matching pattern so that when the male-half connector 36 and the female-half connector 34 are mated, each contact 34, 36 makes contact with each other. Each contact 34, 36 is connected to a conductor (not shown) such as a conductive wire, as is every conductive region. It is appreciated that while plug contact 36 is described as being the male-half connector and receptacle connector 34 is described as being the female-half connector, plug contact 36 may be the female-half connector and receptacle contact 34 may be the male-half connector.

Latch 18 is a fastening mechanism that secures plug 12 to receptacle 14 when plug 12 is mated with receptacle 14. Latch 18 may be a rigid material such as plastic, to provide a levering motion between an engaged and disengaged position. Latch 18 includes a button 38, an arm section 52 and a pawl section 58. A spring 20 is disposed beneath latch 18 to provide a spring force against latch 18 to maintain latch 18 in a normally engaged position to secure plug 12 to receptacle 14. Pawl section 58 engages with an aperture 60 in receptacle 14 to secure plug 12 to receptacle 14 when plug 12 and receptacle 14 are mated. When button 38 is pushed downward into spring 20, arm section 52 pivots about a pivot point 22 (See FIG. 6). Pawl section 58 is displaced upward, releasing pawl section 58 from aperture 60. While spring 20 is described herein, any suitable resistant or spring-like device may be used to provide a force against latch 18 to maintain latch 18 in an engaged position to secure plug 12 to receptacle 14.

Lower plug shield 30 and upper plug shield 28 may be manufactured from a conductive material and are assembled to form an enclosure around and substantially surround plug terminal insert 24, spring 20 and latch 18. The seams (not shown) between upper plug shield 28 and lower plug shield 30 may be sealed with a seal or by an overmold (not shown). The seal may be a plastic material, however any suitable material may be used. A latch cover 76 is disposed to substantially cover any exposed portion of button 38. Lower plug housing 56 and upper plug housing 59 may be constructed from a non-conductive material and are assembled to form an enclosure around lower plug shield 30, upper plug shield 28, plug terminal insert 24, spring 20 and latch 18. Lower plug housing 56 and upper plug housing 59 may be sealed by an overmold 51. Overmold 51 may be a plastic material, however any suitable material may be used. Lower plug housing 56 may include a channel for receiving the overmold 51. When lower plug housing 56 and upper plug housing 59 are mated, overmold 51 is compressed between lower plug housing 56 and upper plug housing 59, creating a waterproof seal. Upper plug housing 59 also includes latch aperture 84, which button 38 and latch cover 76 protrudes when upper plug housing 59 is mated with lower plug housing 56. Latch cover 76 is exposed through and accessible through upper plug housing 59. Latch aperture 84 is dimensioned such that when button 38 is pressed and/or released through latch cover 76, button 38 may freely move.

Lower plug shield 30 and upper plug shield 28 are assembled when the mating features 31 on lower plug shield 30 engage with mating features 31 on upper plug shield 28. Mating features snap together to secure lower plug shield 30 to upper plug shield 28, or vice versa. Lower plug housing 56 may include a plurality of fastener receptacles 80, which protrude upward and engage with apertures 86 in lower plug shield 30, plug terminal insert 24, and upper plug shield 28. Upper plug housing 59 may also include a plurality of fastener receptacles (not shown) that align with fastener receptacles 80. A plurality of fasteners 78 may be used to secure lower plug housing 56 to upper plug housing 59 and thereby secure all components disposed there between. Latch cover 76, latch 18, and spring 20 are secured between the components of plug 12 when the lower plug housing 56 and upper plug housing 59 are secured by fasteners 78. Cable strain relief 82 may be manufactured from a non-conductive material and is attached to plug 12 to provide strain relief to a conductor (not shown). Cable strain relief 82 is attached to plug 12 by capturing it between upper plug housing 59 and lower plug housing 56 or by any other suitable fastening means. Cable strain relief is a flexible material, such as plastic, and provide a waterproof seal to plug 12 as well.

Receptacle 14 may include several components including a receptacle panel gasket 40, an interfacial seal 42, a receptacle terminal insert 44, a receptacle housing 46 and a receptacle shield 48. Receptacle terminal insert 44 is disposed in receptacle shield 48 and receptacle housing 46 and contains at least one contact 36. Receptacle shield 48 is partially disposed in receptacle housing 46 and provides reinforcement and protection to conductor (not shown) used to transmit data, electricity or other information to receptacle contacts 36. Receptacle panel gasket 40 is secured to panel 16. Fasteners 50 secure receptacle housing 46 to panel 16. Interfacial seal 42 may be manufactured from a non-conductive material and provides a barrier for receptacle terminal insert 44 and receptacle contacts 36 from fluids, dust particles and/or other matter. Fasteners 50 may be screws or any suitable fastening devices. Receptacle terminal insert 44, receptacle shield 48, receptacle housing 46, plug terminal insert 24, and interfacial seal 42 may be manufactured from a non-conductive material.

Figure 7:
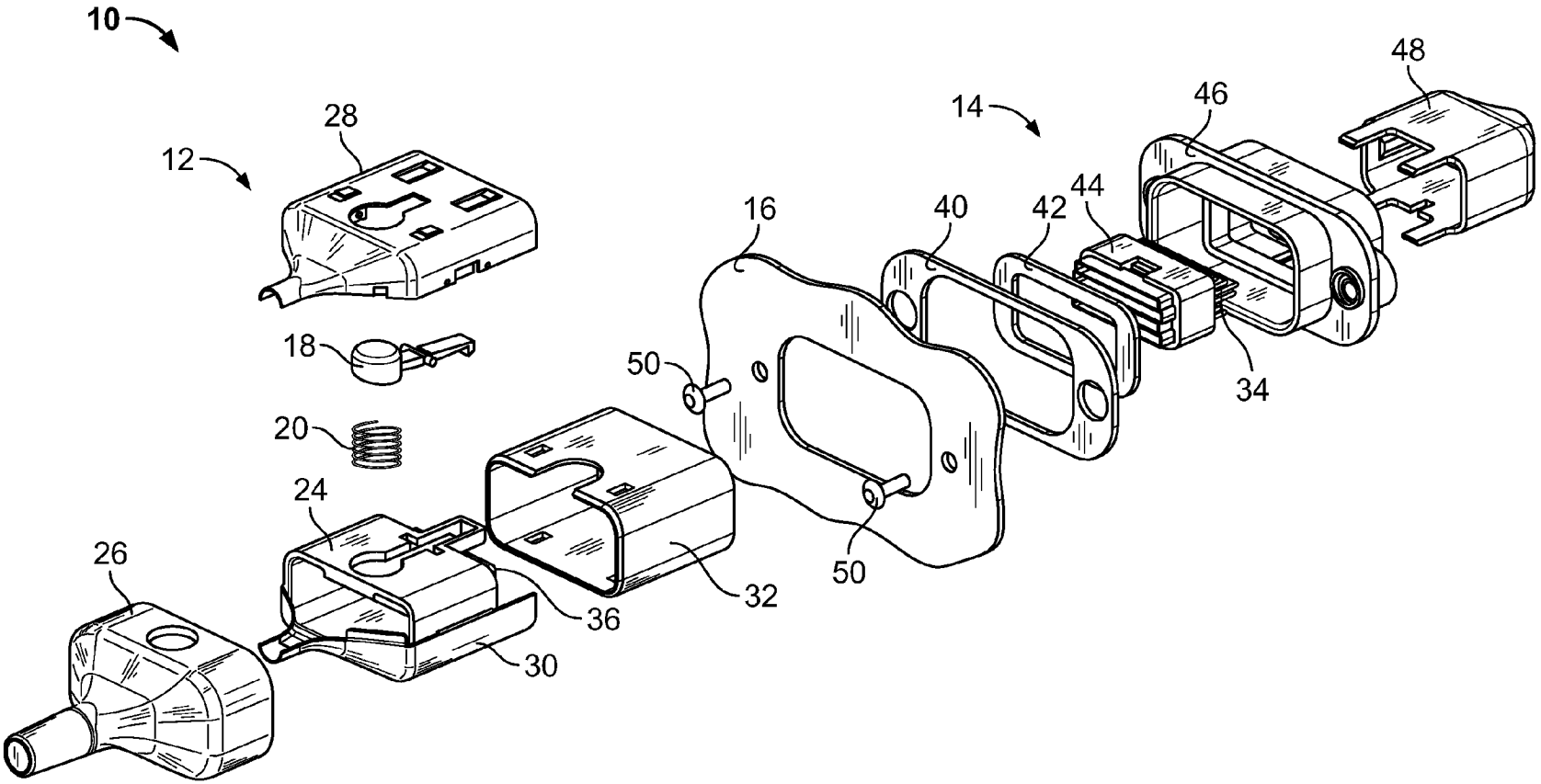
FIG. 7 shows an exploded view of an alternate embodiment of the male and female components of the electrical connector assembly.

FIG. 7 shows an exploded view of an alternate embodiment of electrical connector assembly 10. Electrical connector assembly 10 has a plug 12 and a receptacle 14. Plug 12 includes at least one contact 36 and receptacle 14 includes at least one contact 34. Plug contacts 36 are in communication with receptacle contacts 34 when plug 12 and receptacle 14 are in the mated position (e.g. FIG. 2). Plug contacts 36 and receptacle contacts 34 may be in electronic, data, fluidic, or any combination thereof, communication with each other when plug 12 and receptacle 14 are in the mated position. A fluidic connector (not shown) would provide a contained liquid flow path rather than an electrical connection and may be used alone or in combination with electrical contacts.

Receptacle 14 is typically disposed in a control box or other suitable enclosure, represented by a fragmented section of panel 16. While reference is made to a control box or panel 16 in the current application, any suitable type of enclosure may be used for electrical connector assembly 10. Electrical connector assembly 10 has a rectangular configuration, however electrical connector assembly 10 may have any suitable non-circular configuration such as elliptical. A rectangular shape may provide more clearance between plug contacts 36 and receptacle contacts 34. Further, a rectangular configuration may substantially reduce or substantially eliminate cross talk or interference between plug contacts 36 and receptacle contacts 34. In addition, the rectangular configuration may also provide easier access to plug contacts 36 and receptacle contacts 34 during assembly of electrical connector assembly 10.

Plug 12 may include several components including a plug tail 26, plug terminal insert 24, an upper plug shield 28 and lower plug shield 30, and a plug outer housing 32. Plug terminal insert 24 has at least two contacts 36 that engage or contact the at least two contacts 34 in receptacle 14. Upper plug shield 28 and lower plug shield 30 substantially surround plug terminal insert 24 when upper plug shield 28 and lower plug shield 30 are assembled. Lower plug shield 30 and upper plug shield 28 are assembled when the mating features 31 on lower plug shield 30 engage with mating features 31 on upper plug shield 28. Mating features snap together to secure lower plug shield 30 to upper plug shield 28, or vice versa. Latch 18 and spring 20 are disposed between plug terminal insert 24 and upper plug shield 28. Plug terminal insert 24 may include an aperture to accommodate and accept latch 18 and spring 20 and facilitate movement of latch 18 from an engaged position to a disengaged position. Latch 18 may include an axle, hinge, or pivot point 22 at which it rotates around when latch 18 is pressed against spring 20.

Latch 18 has two predetermined positions, an engaged position and a disengaged position. When latch 18 is in the engaged position, spring 20 is not pressed and latch 18 is secured to receptacle terminal insert 44. Receptacle terminal insert 44 may have an aperture to provide a space for latch 18 to engage. Plug 12 is not easily moveable from receptacle 14 when latch 18 is engaged with receptacle 14. When latch 18 is in the disengaged position, spring 20 is pressed and latch 18 is raised above receptacle terminal insert 44. Plug 12 is easily removable from receptacle 14 when latch 18 is disengaged from receptacle 14. Further, which latch 18 must be pressed into spring 20 to move from the engaged position to the disengaged position, plug 12 may be inserted into receptacle 14 and latch 18 may move from the disengaged position to the engaged position without pressing latch 18 into spring 20. A normal force applied to plug 12 toward receptacle 14 may allow plug 12 to insert into receptacle 14. In addition, while it has been described that latch 18 engages with receptacle terminal insert 44, latch 18 may engage with any suitable component of receptacle 14 to secure plug 12 into receptacle 14.

Plug outer housing 32 is of particular shape and size such that when upper plug shield 28 and lower plug shield 30 are assembled, plug outer housing 32 may substantially surround upper plug shield 28 and lower plug shield 30. Upper plug shield 28 and lower plug shield 30 electrically isolate and ground plug terminal insert 24 and at least two contacts 36 disposed within. Upper plug shield 28 and lower plug shield 30 also provide protection to plug terminal insert 24 by substantially preventing fluid and/or other matter from entering plug terminal insert 24. Plug outer housing 32 is any non-circular shape, and is the same non-circular shape as the remaining components of connector 10. For example, if connecter 10 is substantially rectangular, then plug outer housing 32 is substantially rectangular. Plug outer housing 32 provides additional protection from liquids or other matter from entering plug terminal insert 24 and causing damage to connector 10. Plug outer housing 32 may be a plastic material or any other suitable material.

Plug tail 26 partially fits over plug outer housing 24 and provides reinforcement and protection of any conductor or cable (not shown) used to transmit data, electricity or other information or matter that connector 10 is communicating through at least one contact 36 in plug 12 and at least one contact 34 in receptacle 14. Plug tail 26 is manufactured from a flexible material and fits over plug outer housing 32 such that when plug 12 is engaged with receptacle 14, substantially all of plug outer housing 32 is disposed within receptacle 14 and not exposed.

Receptacle 14 may include a receptacle panel gasket 40, an interfacial seal 42, a receptacle terminal insert 44, a receptacle housing 46 and a receptacle shield 48. Receptacle terminal insert 44 is disposed in receptacle shield 48 and receptacle housing 46 and contains at least one contact 36. Receptacle shield 48 is partially disposed in receptacle housing 46 and provides reinforcement and protection to any wire or cable (not shown) used to transmit data, electricity or other information or matter that connector 10 is communicating through at least two contacts 34 in plug 12 and at least two contacts 36 in receptacle 14. Receptacle panel gasket 40 is in contact with and secured to panel 16 and secures receptacle 14 to panel 16. Fasteners 50 secure receptacle panel housing 46 to panel 16. Interfacial seal 42 provides a seal for receptacle terminal insert 44 and protects at least two contacts 36 in receptacle 14 from damage, fluid or other matter. Fasteners 50 may be screws or other fastening devices. When plug 12 is engaged with receptacle 14, at least two contacts 34 in plug 12 substantially touch at least two contacts 36 in receptacle 14 to provide communication between at least two contacts 34 in plug 12 and at least two contacts 36 in receptacle.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

The invention claimed is:

1. An electrical connector assembly comprising a rectangular plug and a rectangular receptacle;

the rectangular plug comprising:

a plug housing comprising an upper plug housing and a lower plug housing configured to mate with the upper plug housing;

a plug shield comprising an upper plug shield and a lower plug shield configured to mate with the upper plug shield, the mated upper plug shield and lower plug shield being disposed in the mated upper plug housing and lower plug housing;

a plug terminal insert having at least one contact, the plug terminal insert disposed in the plug shield;

a latch configured with a button, an arm section and a pawl section, the latch rotating about a pivot point; and the rectangular receptacle comprising:

a receptacle housing;

a receptacle shield configured to mate with the receptacle housing;

a receptacle terminal insert having an aperture for receiving the pawl, and a least two contacts corresponding with the at least one contact, the receptacle terminal insert being disposed in the receptacle shield; and wherein the pawl engages with the pawl aperture to secure the rectangular plug to the rectangular receptacle when the rectangular plug and the rectangular receptacle are mated.

2. The electrical connector assembly of claim 1, wherein the at least one contact of the plug terminal is a spring loaded pin contact.

3. The electrical connector assembly of claim 1, wherein the at least one contact of the receptacle terminal is a spring loaded pin contact.

4. The electrical connector assembly of claim 1, wherein the upper plug housing and lower plug housing are secured with at least one fastener and wherein the upper plug housing and lower plug housing are sealed.

5. The electrical connector assembly of claim 1, wherein the latch member is spring loaded.

6. The electrical connector assembly of claim 1, wherein the receptacle shield and the plug shield are constructed of a conductive material.

7. The electrical connector assembly of claim 1, wherein the plug tail, plug terminal insert, plug housing, receptacle terminal insert, interfacial seal and receptacle housing are constructed of a non conductive material.

8. The electrical connector assembly of claim 1, wherein the plug comprises twenty-four contacts and the receptacle comprises twenty-four contacts.

9. The electrical connector assembly of claim 1, wherein the at least one contact of the plug and the at least one contact of the receptacle are at least one of fiber-optic, electrical, co-axial, and fluidic.

10. The electrical connector assembly of claim 1, wherein the at least one contact of the plug terminal is static.

11. The electrical connector assembly of claim 1, wherein the plug comprises a latch cover, wherein the latch cover seals the plug from fluids, dust particles and other matter.

12. An electrical connector assembly comprising:

a rectangular plug comprising at least one contact and a latch member; and a rectangular receptacle matable with the rectangular plug, the rectangular receptacle comprising at least one contact and a receiver for the latch member;

wherein the latch member engages with the receiver to secure the plug to the receptacle, wherein the plug is removable from the receptacle when the latch is disengaged, and wherein the latch is sealed with a cover to substantially seal the plug, wherein the receiver for the latch member is a pawl aperture in a receptacle terminal insert and the at least one contact are disposed in the receptacle terminal insert.

13. The electrical connector assembly of claim 12, wherein the rectangular plug comprises:

a plug housing comprising an upper plug housing and a lower plug housing configured to mate with the upper plug housing;

a plug shield comprising an upper plug shield and a lower plug shield configured to mate with the upper plug shield, the mated upper plug shield and lower plug shield being disposed in the mated upper plug housing and lower plug housing;

a plug terminal insert having at least one contact, the plug terminal insert disposed in the plug shield; and a latch configured with a button, an arm section and a pawl section, the latch rotating about a pivot point.

14. The electrical connector assembly of claim 13, wherein the rectangular receptacle comprises:

a receptacle housing;

a receptacle shield configured to mate with the receptacle housing; and a receptacle terminal insert having an aperture for receiving the pawl, and a least two contacts corresponding with the at least one contact, the receptacle terminal insert being disposed in the receptacle shield.

15. The electrical connector assembly of claim 13, wherein the latch cover is a thin, flexible membrane.

16. The electrical connector assembly of claim 12, wherein the at least one contact of the plug terminal is a spring loaded pin contact.

17. The electrical connector assembly of claim 12, wherein the at least one contact of the receptacle terminal is a spring loaded pin contact.

18. The electrical connector assembly of claim 12, wherein the latch member is a spring loaded latch member.

19. The electrical connector assembly of claim 12, wherein the at least one contact is at least one of fiber-optic, electrical, co-axial, and fluidic.

* * * * *